US009119484B2

(12) United States Patent
Hyppolite

(10) Patent No.: US 9,119,484 B2
(45) Date of Patent: Sep. 1, 2015

(54) TRAVEL LAP SEAT FOR A CHILD AND A METHOD FOR ITS USE

(71) Applicant: Marcus A Hyppolite, Corona, NY (US)

(72) Inventor: Marcus A Hyppolite, Corona, NY (US)

( * ) Notice: Subject to any disclaimer, the term of this patent is extended or adjusted under 35 U.S.C. 154(b) by 180 days.

(21) Appl. No.: 14/068,052

(22) Filed: Oct. 31, 2013

(65) Prior Publication Data

US 2015/0115002 A1 Apr. 30, 2015

(51) Int. Cl.
*A47D 13/02* (2006.01)
*A47D 15/00* (2006.01)

(52) U.S. Cl.
CPC ..... *A47D 13/025* (2013.01); *A47D 15/006* (2013.01)

(58) Field of Classification Search
CPC ..... A47D 13/025; A47D 15/006
USPC ..... 224/158–161
See application file for complete search history.

(56) References Cited

U.S. PATENT DOCUMENTS

| | | | | |
|---|---|---|---|---|
| 2,409,331 | A | 10/1946 | Wood | |
| 4,402,440 | A | 9/1983 | Purtzer et al. | |
| 5,205,450 | A * | 4/1993 | Derosier | 224/161 |
| 5,205,451 | A * | 4/1993 | Manzer | 224/161 |
| 7,770,765 | B2 * | 8/2010 | Stevens et al. | 224/160 |
| 7,997,465 | B2 * | 8/2011 | Garofalo et al. | 224/158 |
| 8,752,739 | B2 * | 6/2014 | Bergkvist et al. | 224/160 |
| 2010/0032460 | A1 * | 2/2010 | Hyde | 224/160 |
| 2011/0240693 | A1 * | 10/2011 | Parness et al. | 224/160 |
| 2011/0290831 | A1 * | 12/2011 | Wang | 224/160 |

FOREIGN PATENT DOCUMENTS

| | | |
|---|---|---|
| EP | 0722684 | 7/1996 |
| WO | 2004016479 | 2/2004 |

* cited by examiner

*Primary Examiner* — Gary Elkins
(74) *Attorney, Agent, or Firm* — Law Office of Ilya Libenzon

(57) ABSTRACT

A travel lap seat is disclosed, having a harness and a lap portion. The harness has a first portion that secures the lap seat to an adult, and a second portion that secures a child to the lap seat so that the child sits upon the lap portion when the adult is seated. The harness can also be used as a child carrier. The lap portion may be detachable or stowable, and may be attached to a back portion. The back portion and lap portion may form a single, monolithic unit.

16 Claims, 8 Drawing Sheets

TRAVEL LAP SEAT FOR A CHILD AND A METHOD FOR ITS USE

TECHNICAL FIELD

This invention relates generally to child transportation devices in general, and particularly to travel seats for children.

BACKGROUND ART

Parents find that there are many situations in which they travel with small children in their laps. In crowded trains and buses, placing a child in one's lap can be necessary owing to the density of crowds, concerns for the child's safety, and the child's natural need for affection and a feeling of security. In airplanes, it is often possible for children under two to travel for free in the lap of a parent or guardian. And, where a parent or guardian must use a wheelchair to travel, keeping the child in his or her lap is often a necessity.

However, traveling with lap children presents challenges in its own right. On all kinds of public conveyances, a sudden stop or crash risks sending the child flying, sometimes resulting in serious injury. Airplanes generally require that a lap child be strapped in, but under some circumstances, a child sharing a seat belt with an adult is worse off than an unsecured child, as the much more massive adult can press the child against the belt in the event of a deceleration, causing injury to the child. In any case, traveling for long distances with the child in the adult's lap can be uncomfortable, for both the adult and child. The points on the adult's lap that support the child's weight can become sore over time. The child may also become restless; a trying situation for any parent. If the child is in a baby carrier, the problem of discomfort remains, and is compounded by the back and shoulder strain caused by supporting the child's weight, via the baby carrier, for long distances.

Therefore, there remains a need for a secure, comfortable solution to travel with lap children.

SUMMARY OF THE EMBODIMENTS

Disclosed is a lap seat for a small child, including a harness having a first portion that secures the harness to a seated adult, and a second portion that secures the child in a seated position, and a lap portion attached to the harness so as to rest on top of the lap of the adult and on which the child sits when in the harness.

In a related embodiment, the harness also includes at least one adjustable strap. In an additional embodiment, the first portion includes a belt that encircles the torso of the adult. In another embodiment, the first portion has at least one shoulder strap that passes over a shoulder of the adult. In yet another embodiment, the second portion may be partially detached to free the child. The second portion further includes an inseam strap that passes between the legs of the child, a panel that covers at least the pelvic region of the child, and two side straps securing the panel to the remainder of the lap seat, in another embodiment. According to an additional embodiment, the second portion of the lap seat includes two additional side straps securing the panel to the remainder of the lap seat. The second portion also includes at least one shoulder strap that passes over a shoulder of the child, in another embodiment. In still another embodiment the at least one shoulder strap is secured by a fastener having a reinforced shoulder snap. In a further embodiment, the harness has sufficient tensile strength to support the weight of the child.

In another related embodiment, the lap portion is detachable from the lap seat. In an additional embodiment, the lap portion is stowable. The lap seat includes a substantially planar back portion situated between the adult and the child in another embodiment. Under another embodiment, the back portion is joined to the lap portion and is upwardly angled with respect to the lap portion. In yet another embodiment, the back portion and the lap portion form a single monolithic piece. According to a further embodiment, the harness is joined to the back portion.

A method is also included for traveling with a lap child. The method involves providing a lap seat having a harness with a first part and a second part, and a lap portion. The method further involves securing, by a seated adult, the lap seat to the adult using the first portion of the harness, and securing, by the adult, a child in a seated position on top of the lap portion, using the second portion of the harness.

A related embodiment of the method involves standing up, by the adult, and carrying the child using the harness. In another embodiment of the method, where the second portion is partially detachable, the method involves partially detaching the second portion and removing the child.

Other aspects, embodiments and features of the system and method will become apparent from the following detailed description of the system and method when considered in conjunction with the accompanying figures. The accompanying figures are for schematic purposes and are not intended to be drawn to scale. In the figures, each identical or substantially similar component that is illustrated in various figures is represented by a single numeral or notation at its initial drawing depiction. For purposes of clarity, not every component is labeled in every figure. Nor is every component of each embodiment of the system and method shown where illustration is not necessary to allow those of ordinary skill in the art to understand the system and method.

BRIEF DESCRIPTION OF THE DRAWINGS

The preceding summary, as well as the following detailed description of the system and method, will be better understood when read in conjunction with the attached drawings. It should be understood that the system and method is not limited to the precise arrangements and instrumentalities shown.

DETAILED DESCRIPTION OF SPECIFIC EMBODIMENTS

Embodiments of the disclosed travel lap seat enable an adult to travel securely and comfortably with a small child or infant in his or her lap. The lap portion of the seat distributes the child's weight across the adult's lap to assuage the discomfort resulting from pressure points. The harness system secures the child to the adult to protect the child in the case of accidents or sudden deceleration. If the adult needs to hand the child to another person for a moment, the harness may unbuckle to release the child within five seconds. The harness may also double as a child carrier.

Figure 1:
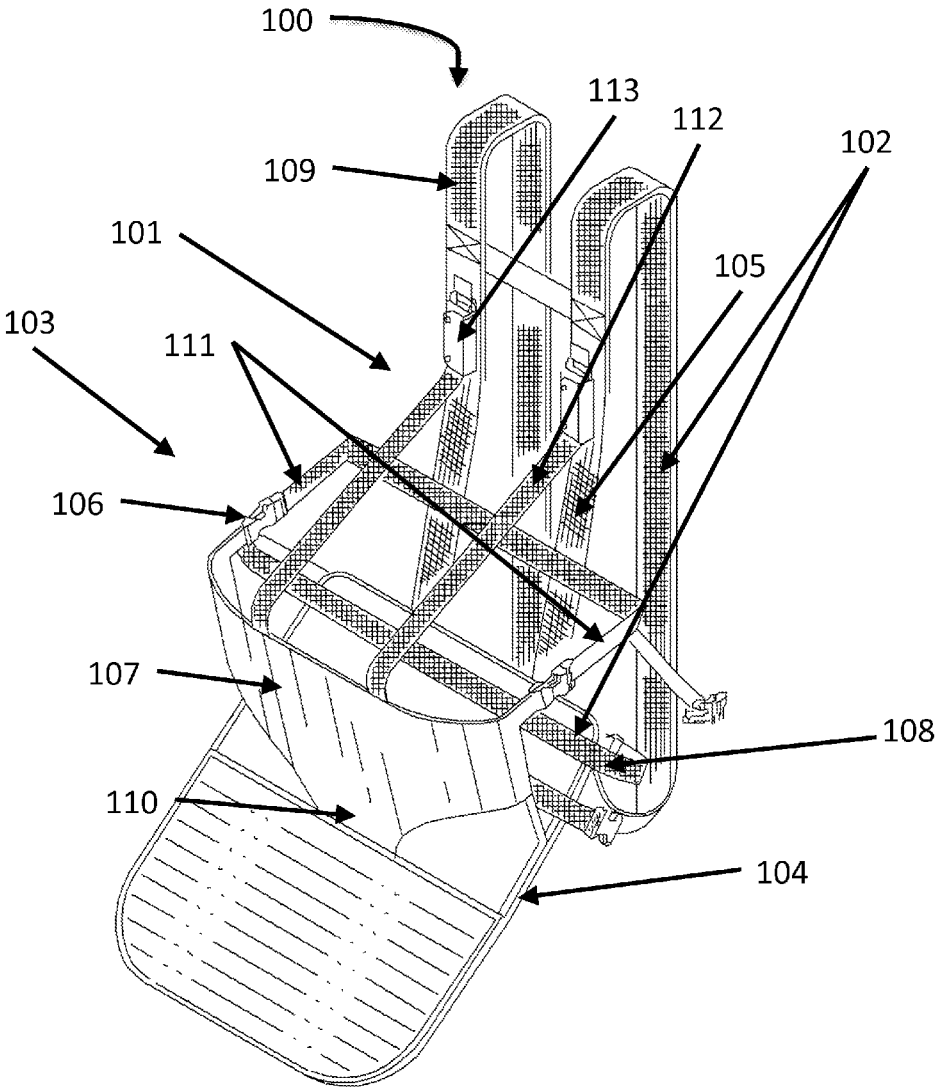
FIG. 1 is a schematic diagram showing a front view of one embodiment of the disclosed lap seat.

FIG. 1 depicts one embodiment of the travel lap seat 100. The lap seat 100 includes a harness 101 having a first portion 102 that secures the harness to a seated adult, and a second portion 103 that secures the child in a seated position. The lap seat also includes a lap portion 104 attached to the harness so as to rest on top of the lap of the adult and on which the child sits when in the harness.

The lap seat 100 includes a harness 101. In some embodiments, the harness 101 functions to secure a child to the adult in a seated position, so that the child sits on the lap portion 104. In some embodiments, the harness 101 has sufficient tensile strength to support the weight of a child as a child carrier. In some embodiments, the harness 101 includes straps 105. The straps 105 may be composed of any material that is flexible and possesses sufficient tensile strength to secure the child. The straps 105 may be leather. The straps 105 may be rubber. The straps 105 may be composed of a flexible polymer. The straps 105 may be composed of natural textile. The straps 105 may be cotton; for instance, the straps may be canvas. The straps 105 may be flax. The straps 105 may be hemp. The straps 105 may be manila hemp. The straps 105 may be silk. The straps 105 may be animal hair, such as wool. The straps 105 may be composed of a synthetic textile. The straps 105 may be nylon. The straps 105 may be polypropylene. The straps 105 may be polyester. The straps 105 may be Dyneema®. The straps 105 may be Kevlar®. In some embodiments, the straps 105 are composed of flat webbing. In other embodiments, the straps 105 are composed of tubular webbing. In some embodiments, the harness 101 includes at least one adjustable strap, defined as a strap whose working length may be increased or decreased by the user.

Some embodiments of the harness include at least one fastener 106. In some embodiments, the at least one fastener 106 is a snap. In some embodiments, the at least one fastener 106 is Velcro. In some embodiments, the at least one fastener 106 is a button. In some embodiments, the at least one fastener 106 is a buckle. The fastener 106 is a hook-and-eye fastener in some embodiments. The fastener 106 may be a cam buckle. The fastener 106 may be a spring buckle. The fastener 106 may be a slide release buckle. The fastener 106 may be a double-loop frame style buckle. The fastener 106 may be a single-loop frame style buckle. The fastener 106 may be a prong frame-style buckle. The fastener 106 may be a plate buckle. The fastener 106 may be a box-out buckle. The fastener 106 may be a clip buckle. The fastener 106 may be a snap buckle. The fastener 106 may be a clasp. The fastener 106 may be a tension lock. The fastener 106 may be a ladder lock. The fastener 106 may be a tri glide.

The fastener 106 may be adjustable, making the strap 105 adjustable as described above. Some fasteners 106, such as the double loop buckle or ladder lock, are inherently adjustable. A fastener 106 that is not adjustable inherently may be made adjustable by including an adjustable form in its design. For example, either the male or female half of a slide-release buckle may be fused to a tension lock through which the strap 105 is threaded, making the slide-release buckle adjustable. The fastener 106 may be composed of any material of sufficient durability, hardness, and elasticity to perform the structural requirements of that type of fastener 106. The fastener 106 may be metal. The fastener 106 may be a hard polymer such as plastic. Where the fastener is a button 106, the fastener may be virtually any material sufficiently rigid to catch the buttonhole.

The harness 101 may include a panel 107. A panel 107 in some embodiments is a planar element. The panel 107 may cover a portion of a person's anatomy while the person is in the harness; in some embodiments, a panel 107 acts to distribute pressure over a broader area than a strap 105 or set of straps 105 would if used for the same structural purpose. In some embodiments, the panel 107 is rigid. The panel 107 may be metal. The panel 107 may be a hard polymer such as plastic. In some embodiments the panel 107 may be composed of any material listed above for straps in reference to FIG. 1, 105. In some embodiments, the harness 101 has padding. The padding may be natural fibrous material. The padding may be animal hair. The padding may be wool. The padding may be feathers. The padding may be a vegetable fiber, such as cotton wool. The padding may be an artificial fibrous material. The padding may be a fibrous polymer material, such as polyester wool. The padding may be a natural foam material. The padding may be sponge. The padding may be latex foam. The padding may be a synthetic foam material. The padding may be a polymer foam, such as polyurethane foam. The padding may be synthetic latex foam. The foam may be open-cell foam. The foam may be closed-cell foam. The foam may be dual-density foam. The foam may have multiple densities. The foam may be compression-molded.

In some embodiments, the travel lap seat 100 is constructed to conform to a set of formal standards. In some embodiments, the travel lap seat 100 is built to conform to the safety standards established by the Consumer product safety improvement act, CPSIA section 101(a)(2), which is incorporated herein by reference [ask client if this is the lead products one]. In some embodiments, the travel lap seat 100 conforms to the standards established by F2236-13 Standard Consumer Safety Specification for Soft Infant and Toddler Carriers, published by ASTM International (formerly the American Society for Testing and Materials), which is incorporated herein by reference. In some embodiments, the travel lap seat 100 conforms to the standards established by clause 4.3.5 of the ASTM International publication F963-11, which is incorporated herein by reference. In some embodiments, the travel lap seat 100 conforms to the standards established by California proposition 65 of 1986, which is incorporated herein by reference. In some embodiments, the travel lap seat 100 conforms to the standards established by the Canada Consumer Safety act (s.c.2010, c.21), which is incorporated herein by reference. In some embodiments, the travel lap seat 100 conforms to the standards established by the Joint Australian and New Zealand. Standards ISO 8124.3:2003/AMDT 1:2010 and 8124 Part 3: 2010 which are incorporated herein by reference. In some embodiments, the travel lap seat 100 conforms to the standards established by the Canadian Toys regulations (SOR/2011-17), which is incorporated herein by reference. In some embodiments, the travel lap seat 100 conforms to the standards established by European Directive 2009/48/EC, which is incorporated herein by reference. In some embodiments, the travel lap seat 100 conforms to the standards established by European Regulation (EC) No 552/2009, which is incorporated herein by reference. In some embodiments, the travel lap seat 100 conforms to the standards established by European Regulation (EC) No 190/2006, which is incorporated herein by reference.

Figure 2:
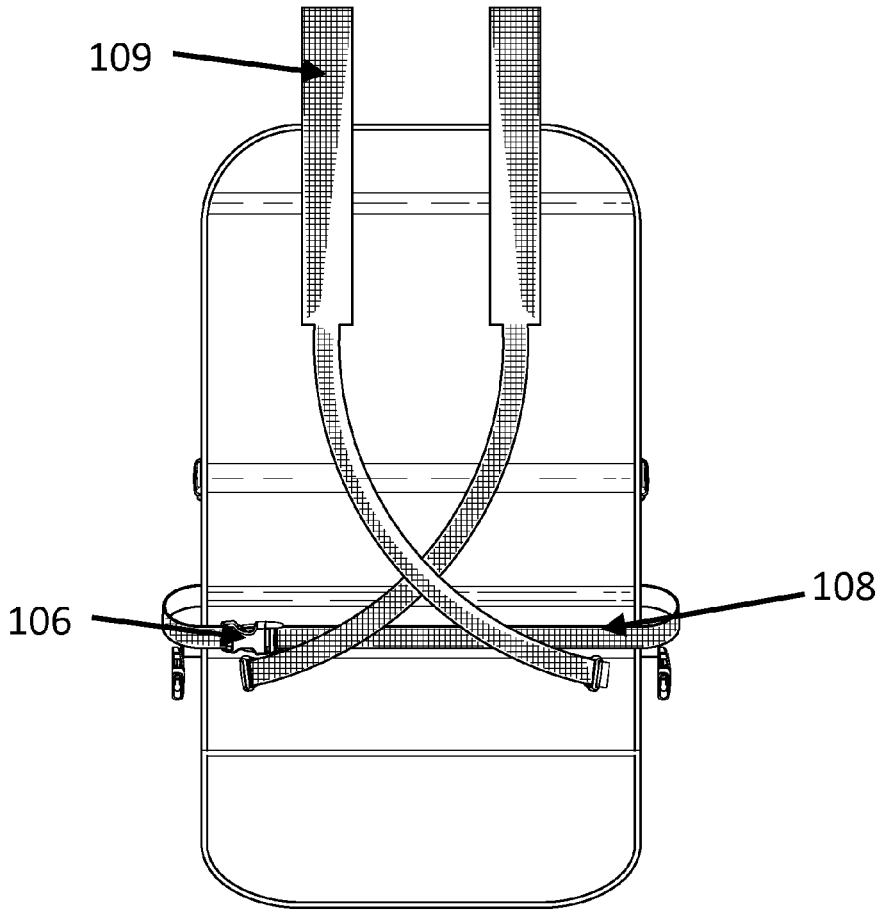
FIG. 2 is a schematic diagram showing a rear view of one embodiment of the disclosed lap seat.

The harness has a first portion 102 that secures the harness to a seated adult. In some embodiments, the first portion 102 includes a belt 108 that encircles the torso of the adult. The belt 108 in some embodiments includes a strap 105 as described above. The strap 105 may be adjustable. In some embodiments, the belt 108 includes a fastener 106 as described above. The fastener 106 may be a buckle. The belt 108 may include padding as described above. The belt 108 may include a panel as described above; for instance, the belt 108 may include a panel to distribute pressure across the lower back of the adult wearing the first portion 102. In some embodiments, the first portion 102 includes at least one shoulder strap 109 that passes over a shoulder of the adult. The at least one shoulder strap 109 in some embodiments includes a strap 105 as described above. The strap 105 may be adjustable. In some embodiments, the at least one shoulder strap 109 includes a fastener 106 as described above. The fastener 106 may be a buckle. The at least one shoulder strap 109 may include padding as described above. The at least one shoulder strap 109 may include a panel as described above; for instance, the portion of the strap that covers the shoulders of the adult, and thus covers the location that bears the most pressure, may be broadened to distribute the pressure more widely across the shoulder. In one embodiment, the at least one shoulder strap 109 is a single strap, such as those used for courier bags. In another embodiment, the at least one shoulder strap 109 is two shoulder straps, such as those used for a backpack. As shown in FIG. 2, the shoulder straps 109 may cross in the back. The first portion 102 in some embodiments includes a combination of a belt 108 with at least one shoulder strap 109.

Figure 3:
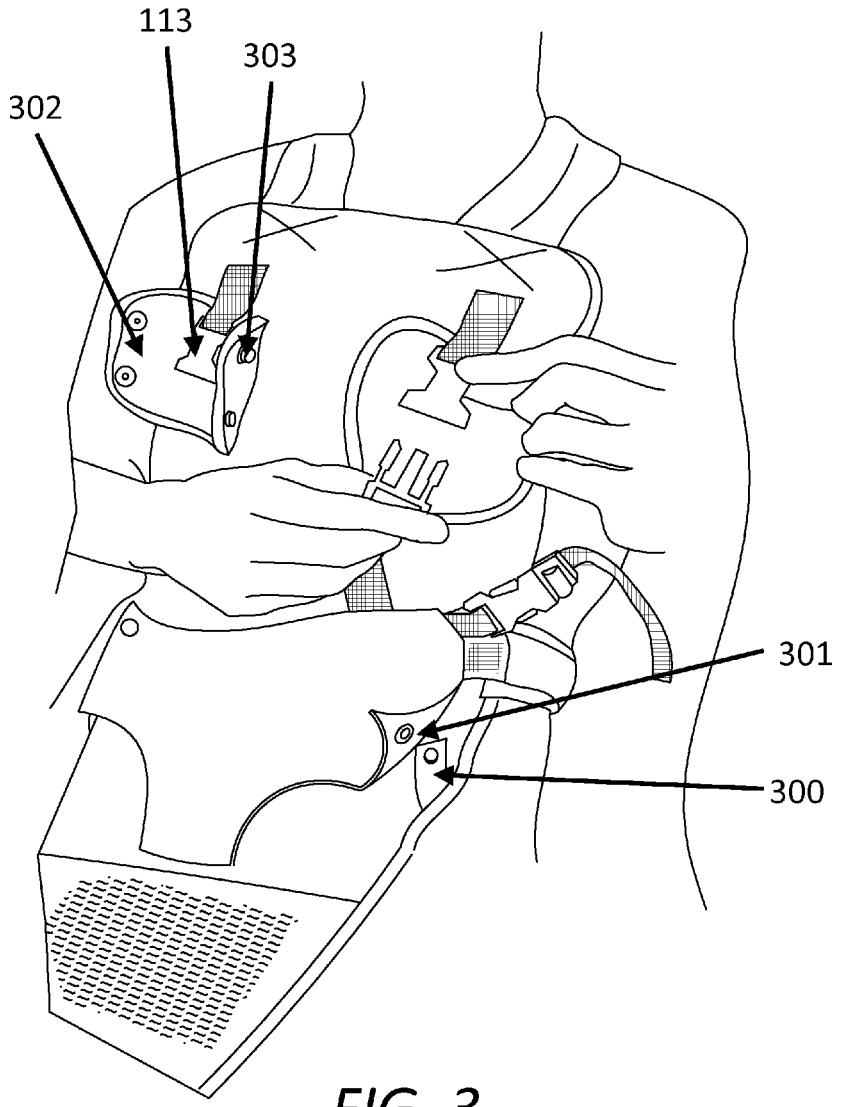
FIG. 3 is a schematic diagram portraying a front view of one embodiment of the disclosed lap seat as worn by an adult.

Returning to FIG. 1, the harness has a second portion 103 that secures the child in a seated position. In some embodiments, the second portion 103 secures the child against the torso of the seated adult. In some embodiments, the second portion 103 may be partially detached to free the child. The second portion 103 may be partially detached, in some embodiments, if all but one of the points of contact between the second portion 103 and the rest of the lap seat 100 may be detached, so that the child can be lifted from the lap seat 100 without resistance. The second portion 103 may be partially detached if it may be entirely detached, as any one of the detachable points of contact could be left attached. In some embodiments, the second portion 103 includes an inseam strap 110 that passes between the legs of the child, a panel 107 that covers at least the pelvic region of the child, and two side straps 111 securing the panel to the remainder of the lap seat. The inseam strap 110 may be a strap 105 as described above. The inseam strap 110 may be a narrowed portion of the panel 107. The side straps 111 may be straps 105 as described above. The side straps 111 may be adjustable. The side straps 111 may be portions of the panel 107. The side straps 111 may have fasteners 106 as described above. As shown in FIG. 3, in some related embodiments, second part 103 also has two additional side straps 300 securing the panel to the remainder of the lap seat. The additional side straps 300 may be straps 105 as described above in reference to FIG. 1. The additional side straps 300 may be adjustable. The additional side straps 300 may be part of the panel 107. The additional side straps 300 may have fasteners 301. The fasteners may be fasteners 106 as described above.

Returning to FIG. 1, in some embodiments, the second portion 103 also includes at least one shoulder strap 112 that passes over a shoulder of the child. The at least one shoulder strap 112 may be a strap 105 as described above. The at least one shoulder strap 112 may be padded. The at least one shoulder strap 112 may be adjustable. The at least one shoulder strap 112 may have an incorporated panel, as described above for a panel 107. For instance, the at least one shoulder strap 112 may have two broadened, padded portions corresponding to its likely area of contact with the child. The at least one shoulder strap may be secured by a fastener 113. The fastener 113 may be a fastener 106 as described above. In some embodiments, at least one shoulder strap is secured by a fastener 113 having a reinforced shoulder snap. FIG. 3 depicts a fastener 113 having a reinforced shoulder snap 302. The fastener 113 may be any fastener 106 as described above in reference to FIG. 1. The reinforced shoulder snap 302 is a soft item designed to envelop the fastener 113 to prevent the fastener 113 from harming the child due to its hardness. The reinforced shoulder snap 302 may be composed of any material disclosed above for a panel 107. In some embodiments, the reinforced shoulder snap 302 is a sleeve. In some embodiments, the sleeve may be parted to form a sheet while the fastener 113 is being fastened or unfastened, and then reformed around the fastener 113 by means of a shoulder snap fastener 303. The shoulder snap fastener 303 may be any fastener 106 as disclosed above by reference to FIG. 1. The shoulder snap fastener 303 may be a snap. In another embodiment, the reinforced shoulder snap 302 is a sleeve that may not be parted to form a sheet, but which can slide or turn inside out to be moved off of the fastener 113 while the fastener 113 is being fastened or unfastened. The reinforced shoulder snap 302 may be attached to a member of the fastener 113. The reinforced shoulder snap 302 may be attached to the at least one shoulder strap 112.

Returning to FIG. 1, the lap seat also includes a lap portion 104 attached to the harness so as to rest on top of the lap of the adult and on which the child sits when in the harness. The lap portion 104 may be made of any materials described above for a panel 107. The lap portion 104 may have more than one layer of material; for instance, the lap portion 104 may have a core sheet of polymer with a greater degree of stiffness than that found in textiles, and an exterior sleeve of textile material. Other layers might include padding, as defined above. In some embodiments, the lap portion 104 is detachable from the lap seat. In some embodiments, a portion of the lap seat 100 is "detachable" if it may be detached and reattached, and used subsequent to reattachment with no loss of function.

In some embodiments, the lap portion is stowable. The lap portion 104 may be stowable if it may be folded, rolled, or crumpled and secured in that form. The stowable lap portion 104 may be secured by tying it in place. The stowable lap portion 104 may be secured in its stowed form by straps 105 as described above. The stowable lap portion 104 may be secured in its stowed form by fasteners 105 as described above. The stowable lap portion 104 may be secured in its stowed form by a zipper. The stowable lap portion 104 may be stowed in a pocket.

Figure 4:
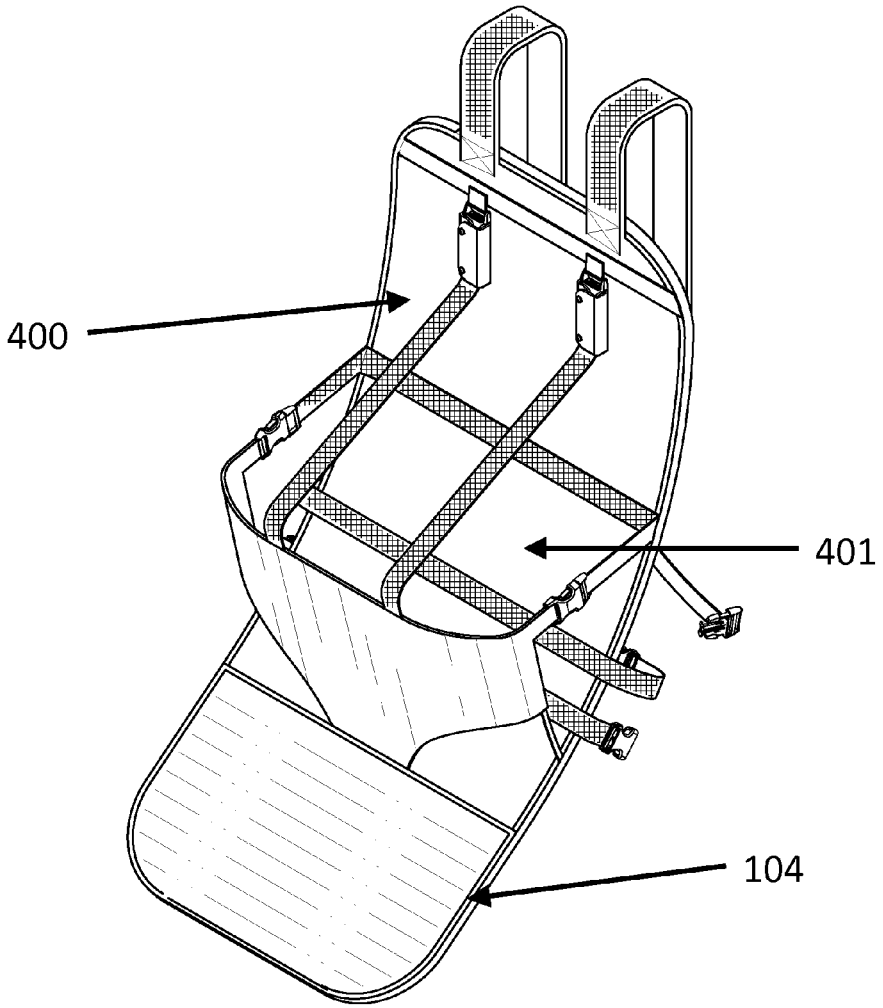
FIG. 4 is a schematic diagram showing a front view of one embodiment of the disclosed lap seat.
Figure 5:
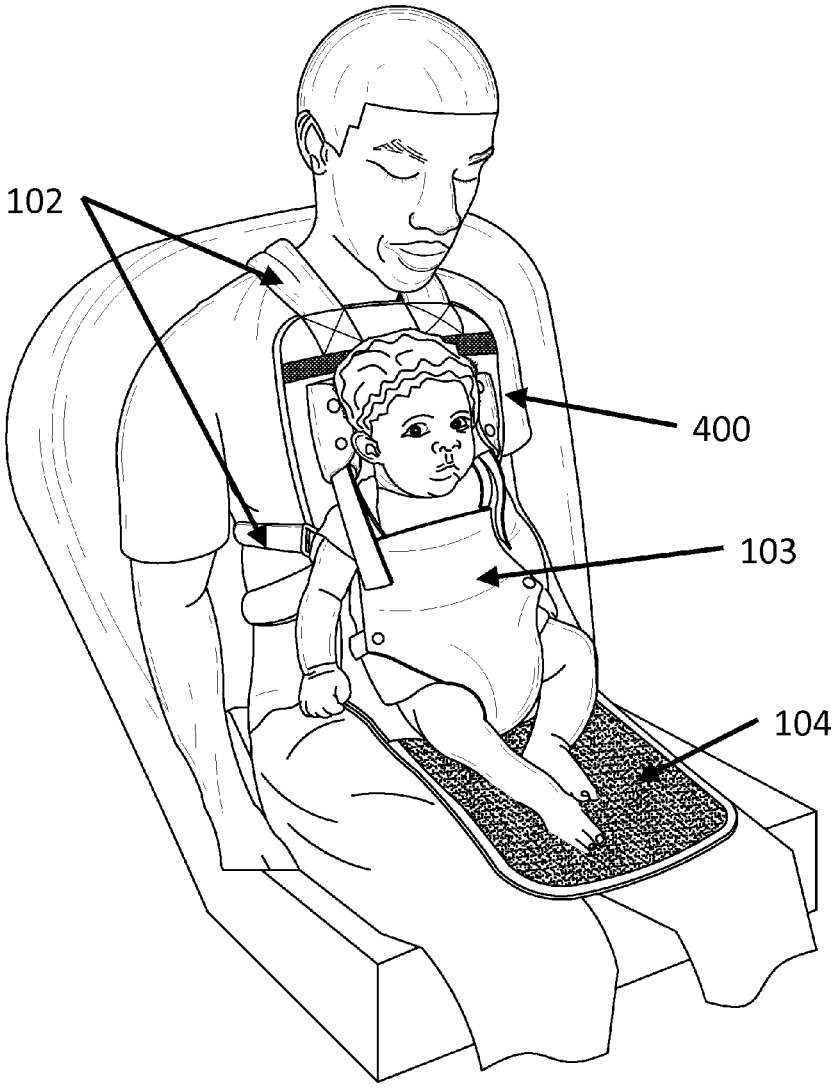
FIG. 5 is a schematic diagram portraying a front view of one embodiment of the disclosed lap seat as worn by an adult, and with a child placed in the lap seat.

As shown in FIG. 4, some embodiments of the lap seat 100 also include a substantially planar back portion 400 situated between the adult and the child. The back portion 400 may be made of any materials described above for a panel 107. The back portion 400 may have more than one layer of material; for instance, the back portion 400 may have a core sheet of polymer with a greater degree of stiffness than that found in textiles, with an exterior sleeve of textile material. Other layers might include padding, as defined above. In some embodiments, the back portion 400 is joined to the lap portion and is upwardly angled with respect to the lap portion 104. The angle between the back portion 400 and the lap portion 104 may be shallow, or obtuse, when the lap seat 100 is not in use, as shown in FIG. 4. The materials of which the back portion 400 and lap portion 104 are composed may be sufficiently flexible to bend into a substantially perpendicular angle when in use, as shown in FIG. 5, which depicts a child and adult in the second portion 103 and first portion 102 of the harness respectively, with the child sitting on the lap portion 104 in a substantially upright position, supported by the back portion 400. In some embodiments, the back portion 400 and the lap portion 104 form a single monolithic piece 401. The single monolithic piece 401 may be made of any materials described above for a panel 107. The single monolithic piece 401 may have more than one layer of material; for instance, the single monolithic piece 401 may have a core sheet of polymer with a greater degree of stiffness than that found in textiles, and an exterior sleeve of textile material. Other layers might include padding, as defined above.

Figure 6:
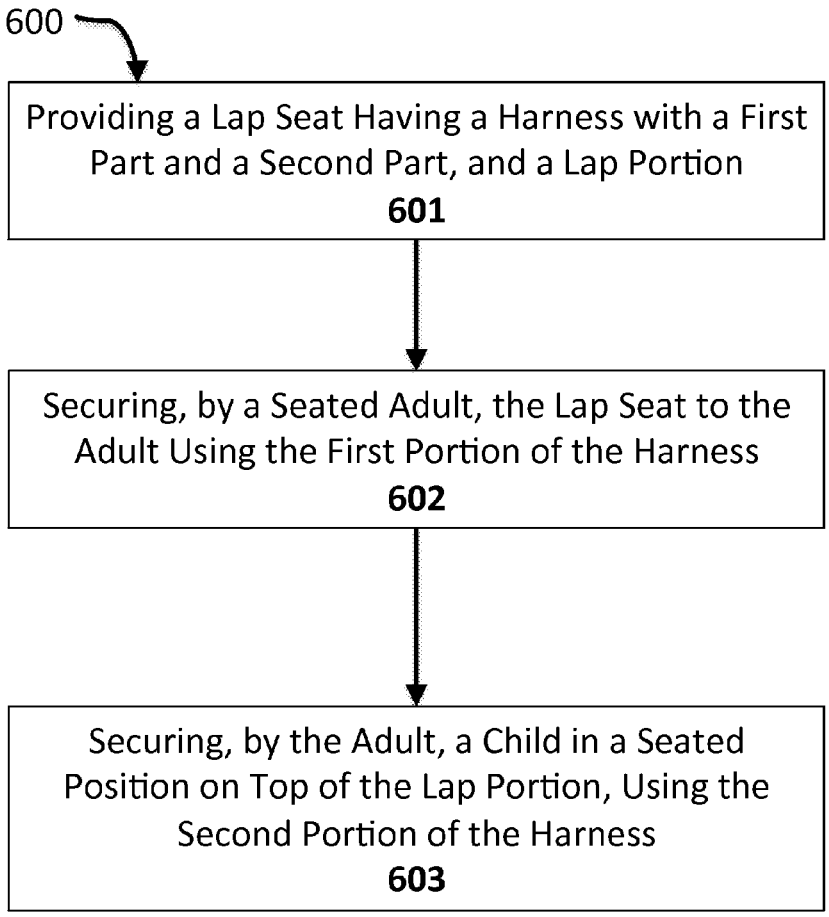
FIG. 6 is a flowchart depicting one embodiment of a method for traveling with a lap child.

FIG. 6 is a flow chart depicting a method 600 for traveling with a lap child. The method 600 includes providing a lap seat as provided above in reference to FIG. 1 (601). The method 600 includes securing, by a seated adult, the lap seat to the adult using the first portion of the harness (602). The method 600 includes securing, by the adult, a child in a seated position on top of the lap portion, using the second portion of the harness (603).

Referring to FIG. 6 in greater detail, and by reference to FIGS. 1-5, the method 600 includes providing a lap seat 100 as provided above in reference to FIG. 1 (601). The lap seat 100 may include any feature described above in reference to FIGS. 1-5. Where the lap portion 104 is detached, the method 600 may include attaching the lap portion 104. Where the lap portion 104 is stowed, the method 600 may include unstowing the lap portion 104.

Figure 7:
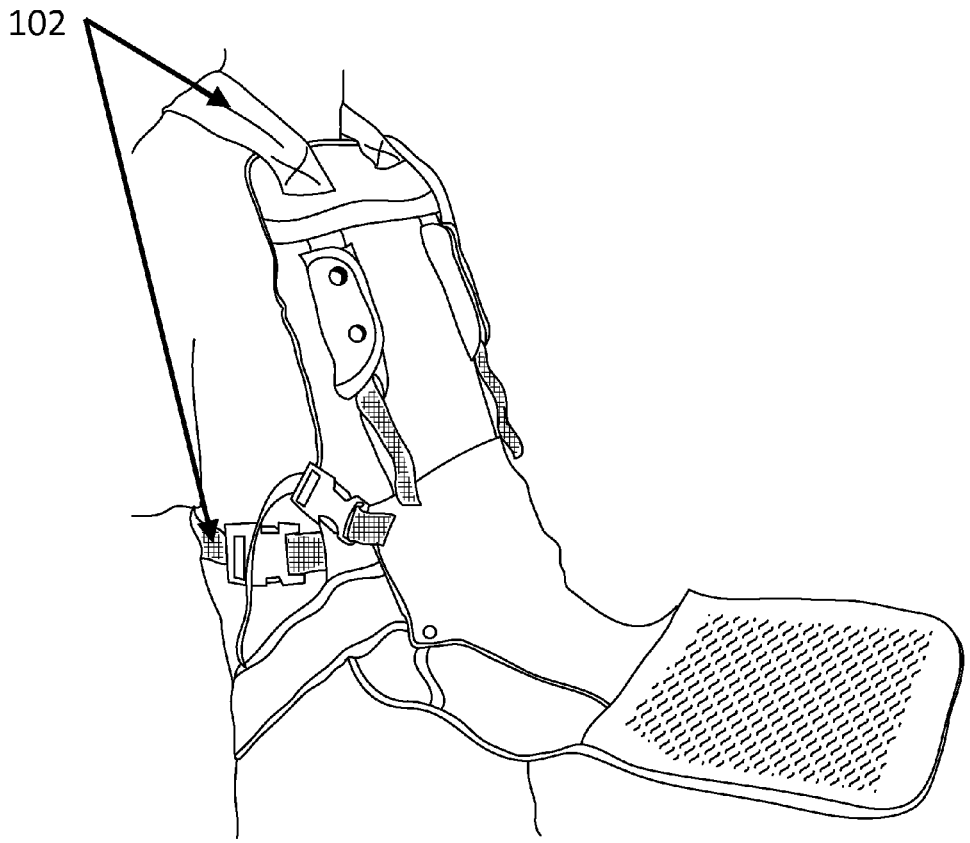
FIG. 7 is a schematic diagram showing a side view of an adult wearing the lap seat.

The method 600 includes securing, by a seated adult, the lap seat 100 to the adult using the first portion 102 of the harness (602). Where the first portion 102 includes a belt 108, securing the first portion 102 to the adult involves placing the belt around the torso of the adult; the torso for the purposes used herein may include the waist. Where the belt 108 has a fastener 106 it may be placed around the torso of the adult by encircling the torso with the unfastened belt 108 and engaging the fastener 106. Where the belt 108 includes an adjustable strap 105, the belt 108 may be adjusted to fit the torso of the adult by adjusting the adjustable strap 105. Where the first portion 102 includes at least one shoulder strap 109, securing the first portion 102 to the adult involves placing the at least one shoulder strap 109 over a shoulder of the adult. Where the least one shoulder strap 109 has a fastener 106 it may be placed over a shoulder of the adult by passing the unfastened least one shoulder strap 109 over the shoulder of the adult and engaging the fastener 106. Where the least one shoulder strap 109 includes an adjustable strap 105, the least one shoulder strap 109 may be adjusted to fit over a shoulder of the adult by adjusting the adjustable strap 105. FIG. 7 shows the lap seat secured to an adult, using the first portion of the harness 102.

Figure 8:
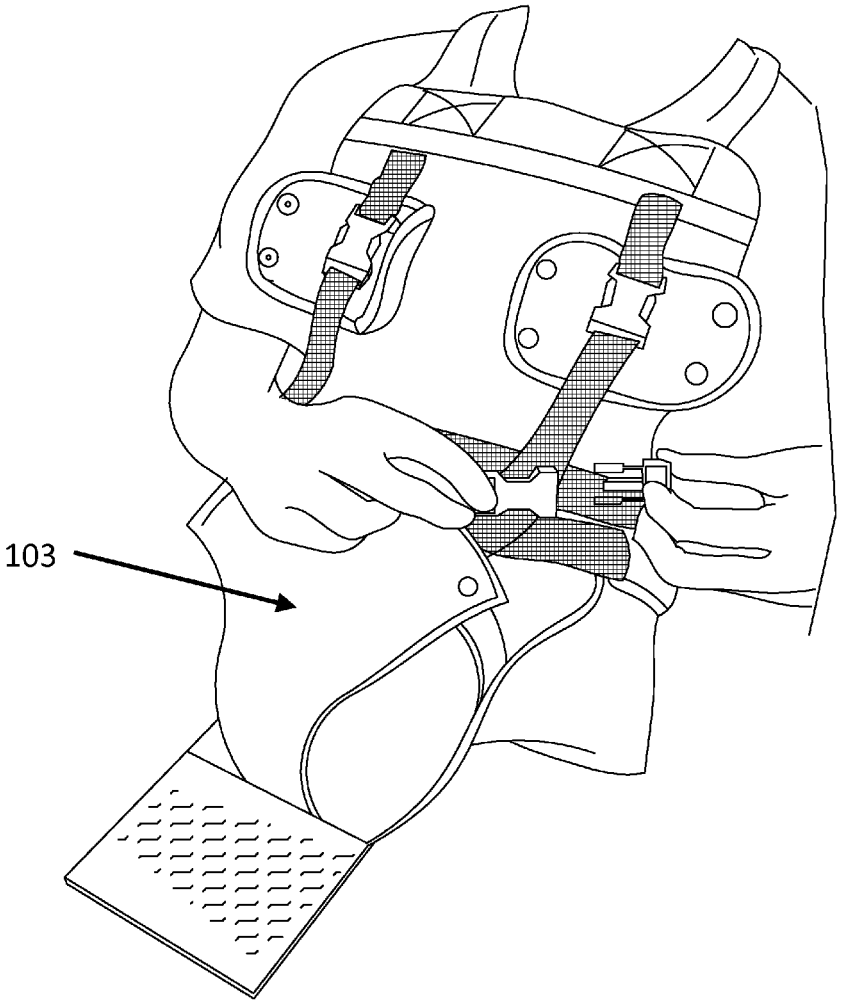
FIG. 8 is a schematic diagram showing an adult attaching the second portion of the harness.

Returning to FIG. 6, the method 600 includes securing, by the adult, a child in a seated position on top of the lap portion, using the second portion 103 of the harness (603). Where the second portion 103 is partially detachable, securing the child may involve partially detaching the second portion 103, placing the child on the lap portion 104 in a seated position, and then fully attaching the second portion 103 by reattaching it at each point of contact. Where the points of contact are attached using fasteners 106, the points of contact may be reattached by fastening the fasteners 106. As an example, where the second portion 103 includes an inseam strap 110, a panel 107, and two side straps 111, and the two side straps 111 have fasteners 106, the reattachment may be accomplished by pulling the second portion 103 through the inseam, so that the inseam strap 110 passes through the inseam, and fastening the fasteners 106 of the two side straps 111. Where the second portion 103 also includes two additional side straps 300, and those side straps have fasteners 106, reattaching the second portion 103 may involve fastening the fasteners of the two additional side straps 300. For a child who needs a roomier fit, the two additional side straps 300 may be kept unfastened when the child is secured; if the child is inserted in a fully attached second portion 103 as described below, the two additional side straps 300 may be unfastened to produce a roomier fit. Where the second portion 103 includes at least one shoulder strap 112, and the at least one shoulder strap has a fastener 113, reattaching the second portion 103 may involve fastening the fastener 113. Securing the child 603 may also involve placing the child into a fully attached second portion 103. Skilled practitioners in the art will recognize that the child may be placed in a second portion 103 in any intermediate state of attachment between fully detached and fully attached. Where the second portion 103 includes at least one adjustable strap 105, the second portion may be adjusted to fit the child correctly by adjusting the at least one adjustable strap 105. FIG. 8 shows the second portion 103 of the harness in the process of being attached.

Returning to FIG. 6, in some embodiments, the method 600 involves standing up, by the adult, and carrying the child using the harness. In some embodiments, the harness 101 possesses the tensile strength necessary to bear the weight of a child. When the adult is standing, the adult may bear the weight of the child where first portion 102 of the harness engages the adult's body. Where the first portion 102 includes a belt, the adult may bear the weight of the child on the belt. Where the first portion 102 includes at least one shoulder strap 109, the shoulder strap may bear the weight of the child. Where the first portion 102 includes both a belt and at least one shoulder strap, the weight of the child may be distributed between the belt 108 and the at least one shoulder strap 109. Where the lap portion 104 is detachable, carrying the child using the harness may involve detaching the lap portion 104. Where the lap portion 104 is stowable, carrying the child using the harness may involve stowing the lap portion 104.

In some embodiments, where the second portion 103 is partially detachable, the method 600 includes partially detaching the second portion and removing the child. Where the second portion 103 includes fasteners 106 as provided above, partially detaching the second portion 103 may be accomplished by unfastening the fasteners. In some embodiments, where the second portion 103 includes an inseam strap 110, a panel 107, and two side straps 111, and the two side straps 111 have fasteners 106, the partial detachment may be accomplished by unfastening the fasteners 106 of the two side straps 111. Where the second portion 103 also includes two additional side straps 300, and those side straps have fasteners 106, partially detaching the second portion 103 may involve unfastening the fasteners of the two additional side straps 300. Where the second portion 103 includes at least one shoulder strap 112, and the at least one shoulder strap has a fastener 113, partially detaching the second portion 103 may involve unfastening the fastener 113.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A lap seat for a small child, comprising:

a harness having a first portion that secures the harness to a seated adult, and a second portion that secures the child in a seated position;

a substantially planar back portion situated between the adult and the child; and a lap portion attached to the harness so as to rest on top of the lap of the adult and on which the child sits when in the harness;

wherein the back portion and the lap portion form a single monolithic piece.

2. A lap seat according to claim 1, wherein the harness further comprises at least one adjustable strap.

3. A lap seat according to claim 1, wherein the first portion further comprises a belt that encircles the torso of the adult.

4. A lap seat according to claim 1, wherein the first portion further comprises at least one shoulder strap that passes over a shoulder of the adult.

5. A lap seat according to claim 1, wherein the second portion may be partially detached to free the child.

6. A lap seat according to claim 1, wherein the second portion further comprises an inseam strap that passes between the legs of the child, a panel that covers at least the pelvic region of the child, and two side straps securing the panel to the remainder of the lap seat.

7. A lap seat according to claim 6, further comprising two additional side straps securing the panel to the remainder of the lap seat.

8. A lap seat according to claim 1, wherein the second portion of the harness further comprises at least one shoulder strap that passes over a shoulder of the child.

9. A lap seat according to claim 8, wherein the at least one shoulder strap is secured by a fastener having a reinforced shoulder snap.

10. A lap seat according to claim 1, wherein the harness has sufficient tensile strength to support the weight of the child.

11. A lap seat according to claim 1, wherein the lap portion is stowable.

12. A lap seat according to claim 1, where the back portion is joined to the lap portion and is upwardly angled with respect to the lap portion.

13. A lap seat according to claim 1, wherein the harness is joined to the back portion.

14. A method for traveling with a lap child, the method comprising:

providing a lap seat according to claim 1;

securing, by a seated adult, the lap seat to the adult using the first portion of the harness; and securing, by the adult, a child in a seated position on top of the lap portion, using the second portion of the harness.

15. A method according to claim 14, further comprising standing up, by the adult, and carrying the child using the harness.

16. A method according to claim 14, wherein the second portion is partially detachable and further comprising partially detaching the second portion and removing the child.

* * * * *